US007727006B1

(12) United States Patent
Huang

(10) Patent No.: US 7,727,006 B1
(45) Date of Patent: Jun. 1, 2010

(54) CONNECTOR FOR FLEXIBLE PRINTED CIRCUIT BOARD

(75) Inventor: Sheng-Yuan Huang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/507,983

(22) Filed: Jul. 23, 2009

(51) Int. Cl.
*H01R 12/24* (2006.01)

(52) U.S. Cl. ..... 439/495

(58) Field of Classification Search ..... 439/495, 439/260, 59

See application file for complete search history.

(56) References Cited

U.S. PATENT DOCUMENTS

| | | | | |
|---|---|---|---|---|
| 5,895,287 | A * | 4/1999 | Seto et al. | 439/495 |
| 6,056,572 | A * | 5/2000 | Matsumoto et al. | 439/260 |
| 6,224,418 | B1 * | 5/2001 | Miura et al. | 439/495 |
| 6,338,648 | B1 * | 1/2002 | Miura et al. | 439/495 |
| 6,514,101 | B1 * | 2/2003 | Miura | 439/495 |
| 6,533,606 | B2 * | 3/2003 | Yamane | 439/495 |
| 7,063,559 | B2 * | 6/2006 | Wang et al. | 439/495 |
| 7,261,588 | B2 * | 8/2007 | Yokoyama | 439/495 |
| 7,491,088 | B2 * | 2/2009 | Suzuki et al. | 439/607.01 |
| 7,494,366 | B2 * | 2/2009 | Suzuki et al. | 439/495 |
| 7,648,386 | B2 * | 1/2010 | Suzuki et al. | 439/495 |

* cited by examiner

*Primary Examiner*—Neil Abrams
*Assistant Examiner*—Harshad C Patel
(74) *Attorney, Agent, or Firm*—Cheng-Ju Chiang

(57) ABSTRACT

A connector adapted for receiving a flexible printed circuit board therein includes an insulating housing defining a mouth, a plurality of electric terminals each having a base portion and an actuator pivoted in the mouth. Each side wall of the mouth defines a first locating trough and a second locating trough. The electric terminal has a contacting arm and a connecting arm respectively extended from the base portion, and a bearing arm and a holding arm respectively extended from the base portion. The actuator has a pressing bar at an edge thereof and two piloting portions. The pressing bar is located between the bearing arms and the holding arms. The piloting portions are slid into the corresponding second locating troughs from the first locating troughs to act on the bearing arms so as to make the contacting arms incline toward the corresponding connecting arms for further clipping the flexible printed circuit board therebetween.

7 Claims, 6 Drawing Sheets

CONNECTOR FOR FLEXIBLE PRINTED CIRCUIT BOARD

BACKGROUND OF THE INVENTION

1. Field of the Invention

The present invention generally relates to an electrical connector, and more particularly to a connector for a flexible printed circuit (FPC hereinafter for simplification) board.

2. The Related Art

A conventional FPC connector adapted for receiving an FPC board therein includes an insulating housing, a plurality of electric terminals disposed in the insulating housing and an actuator pivoted to the insulating housing. The insulating housing defines a mouth at an end thereof for receiving the actuator therein. Each of the electric terminals has a base portion. A contacting portion and a connecting portion are extended from the base portion at an upper portion and a lower portion respectively. The FPC board is inserted between the contacting portions and the connecting portions to form an electrical connection between the FPC board and the electric terminals. Then the actuator can pivot from an open position to a closed position. While the insulating housing is at the closed position, the FPC board is held between the contacting portions and the connecting portions under a pressure from the actuator. However, the pressure from the actuator cannot hold the FPC board firmly, so that the electrical connection between the FPC board and the electric terminals is not stable.

SUMMARY OF THE INVENTION

An object of the present invention is to provide a connector adapted for receiving a longitudinally inserted flexible printed circuit board therein. The connector includes an insulating housing, a plurality of electric terminals disposed in the insulating housing in a transverse row and an actuator. The insulating housing defines a mouth at a rear thereof and a receiving recess at a front thereof for receiving the flexible printed circuit board therein. A front wall of the mouth protrudes rearward to form a tongue board. Each side wall of the mouth defines a first locating trough and a second locating trough in front of the first locating trough. A projection is formed between the first locating trough and the second locating trough. Each of the electric terminals has a lying-H shaped base frame which has a base portion. The electric terminal further has a contacting arm and a connecting arm extended frontward from the base portion and spaced from each other, and both a bearing arm and a holding arm extended from an upper portion and a lower portion of the base portion respectively and spaced from each other. The contacting arm and the connecting arm are disposed in the inner surfaces of the receiving recess. The holding arm is disposed in the tongue board and the bearing arm stretches into the mouth. The flexible printed circuit board is inserted between the contacting arms and the connecting arms for electrically connecting the electric terminals. The actuator is pivoted in the mouth of the insulating housing above the tongue board. The actuator has a pressing bar transversely formed at an edge thereof and two piloting portions protruded oppositely from two opposite ends of the pressing bar. The pressing bar is located between the bearing arms and the holding arms. The piloting portions are slid into the corresponding second locating troughs from the first locating troughs pivoted with the piloting portions by way of the projections to act on the bearing arms by the pressing bar so as to make the contacting arms incline toward the corresponding connecting arms for further clipping the flexible printed circuit board therebetween after the actuator is closed.

As described above, the pressing bar of the actuator are located between the bearing arms and the holding arms to make the flexible printed circuit board be tightly clipped between the contacting arms and the connecting arms by means of a fulcrum function of the corresponding base portions so as to ensure a more steady electrical connection between the electric terminals and the flexible printed circuit board.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
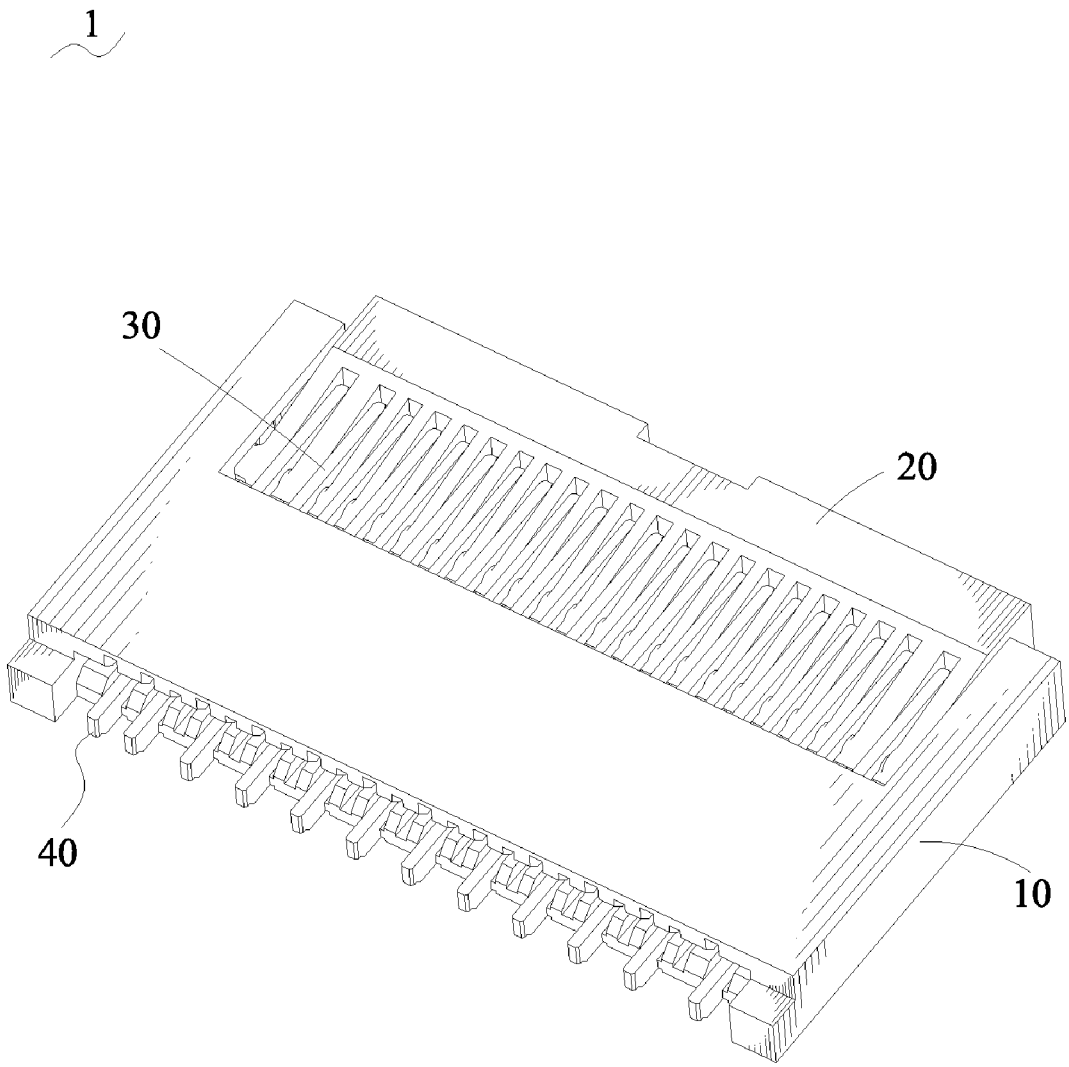
FIG. 1 is a perspective view of an FPC connector in accordance with the present invention.
Figure 2:
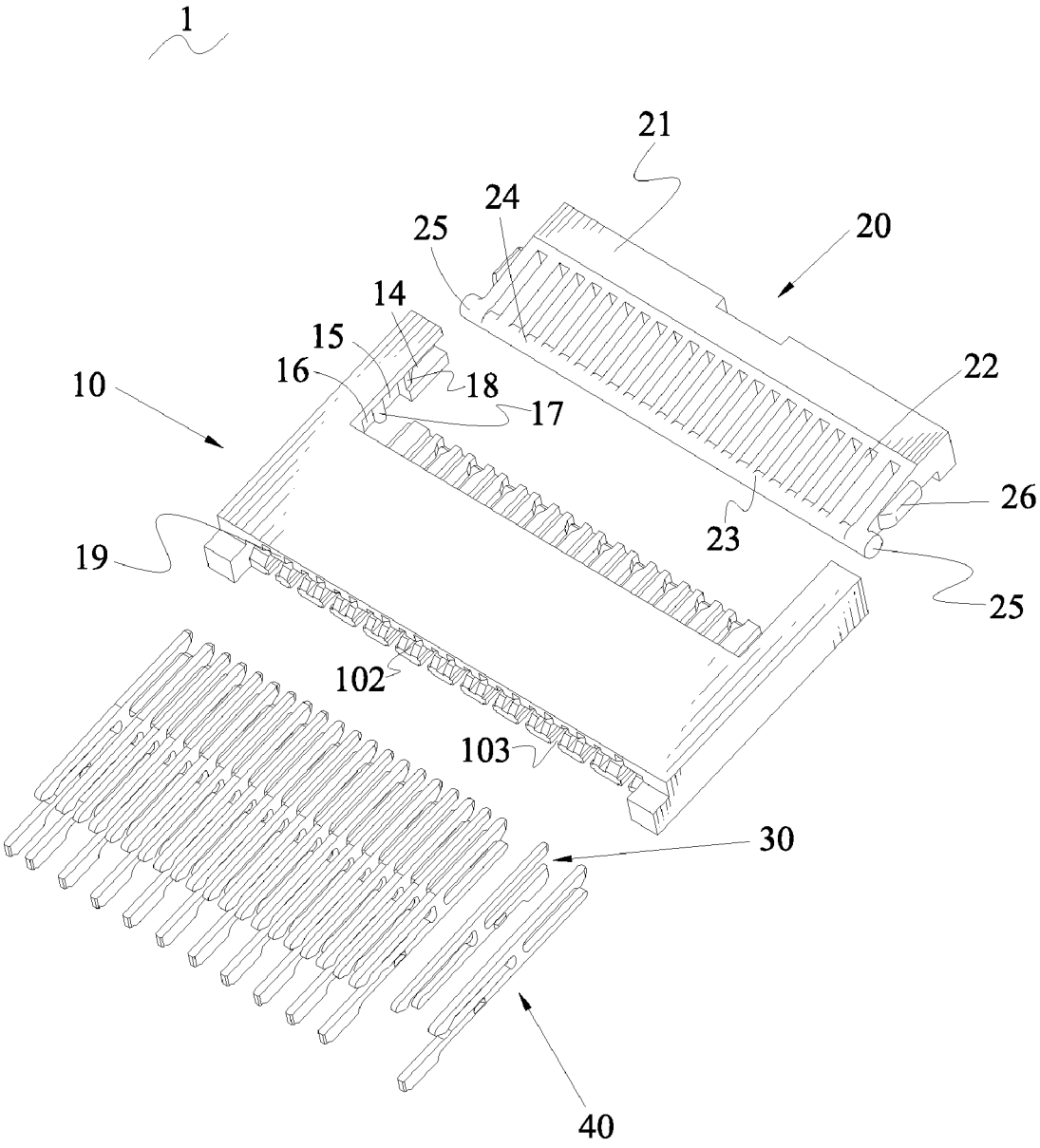
FIG. 2 is an exploded view of the FPC connector of FIG. 1.

Referring to FIG. 1 and FIG. 2, an FPC connector 1 in accordance with the present invention includes an insulating housing 10, an actuator 20 pivoted to the insulating housing 10 between an open position and a closed position, a plurality of first electric terminals 30 and a plurality of second electric terminals 40 disposed in the insulating housing 10 respectively.

Figure 3:
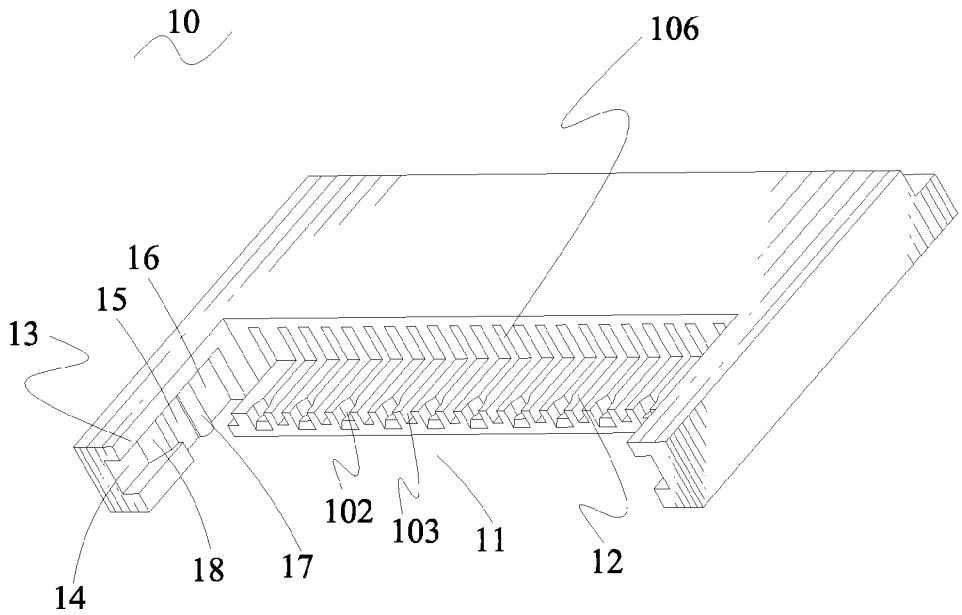
FIG. 3 is a perspective view of an insulating housing of the FPC connector of FIG. 1.
Figure 4:
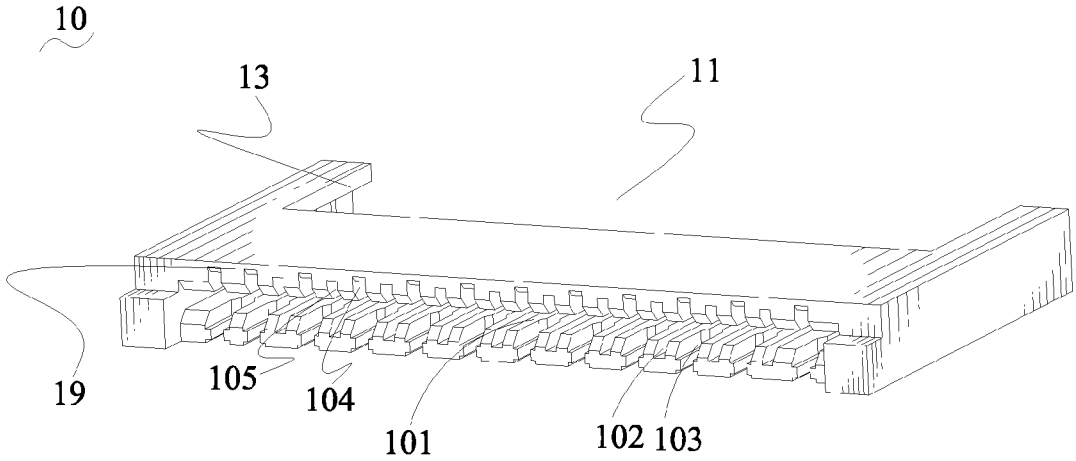
FIG. 4 is the same view as FIG. 3, but showing the insulating housing from another viewing angle.
Figure 7:
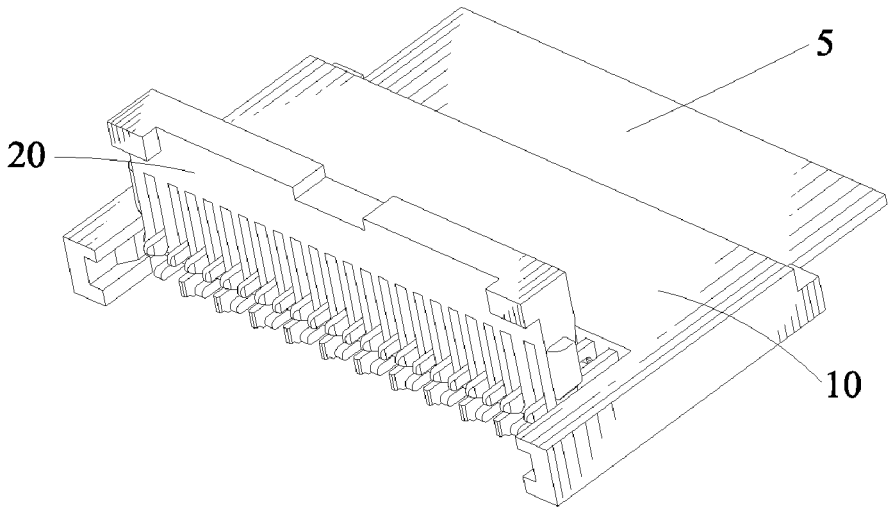
FIG. 7 is a perspective view of the FPC connector of FIG. 1, wherein an FPC board is inserted therein and an actuator of the FPC connector is opened.
Figure 8:
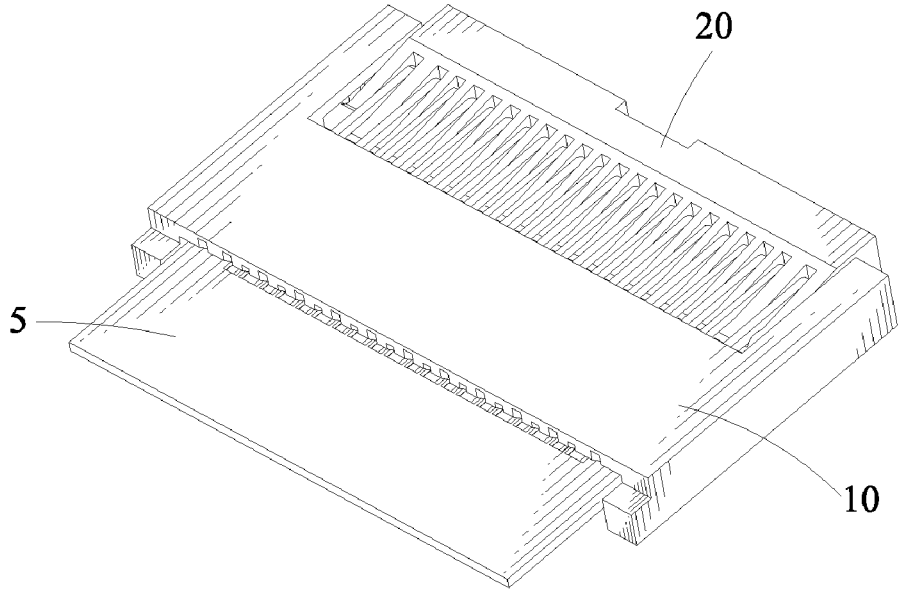
FIG. 8 is a perspective view of the FPC connector of FIG. 1, wherein the FPC board is inserted therein and the actuator of the FPC connector is closed.
Figure 9:
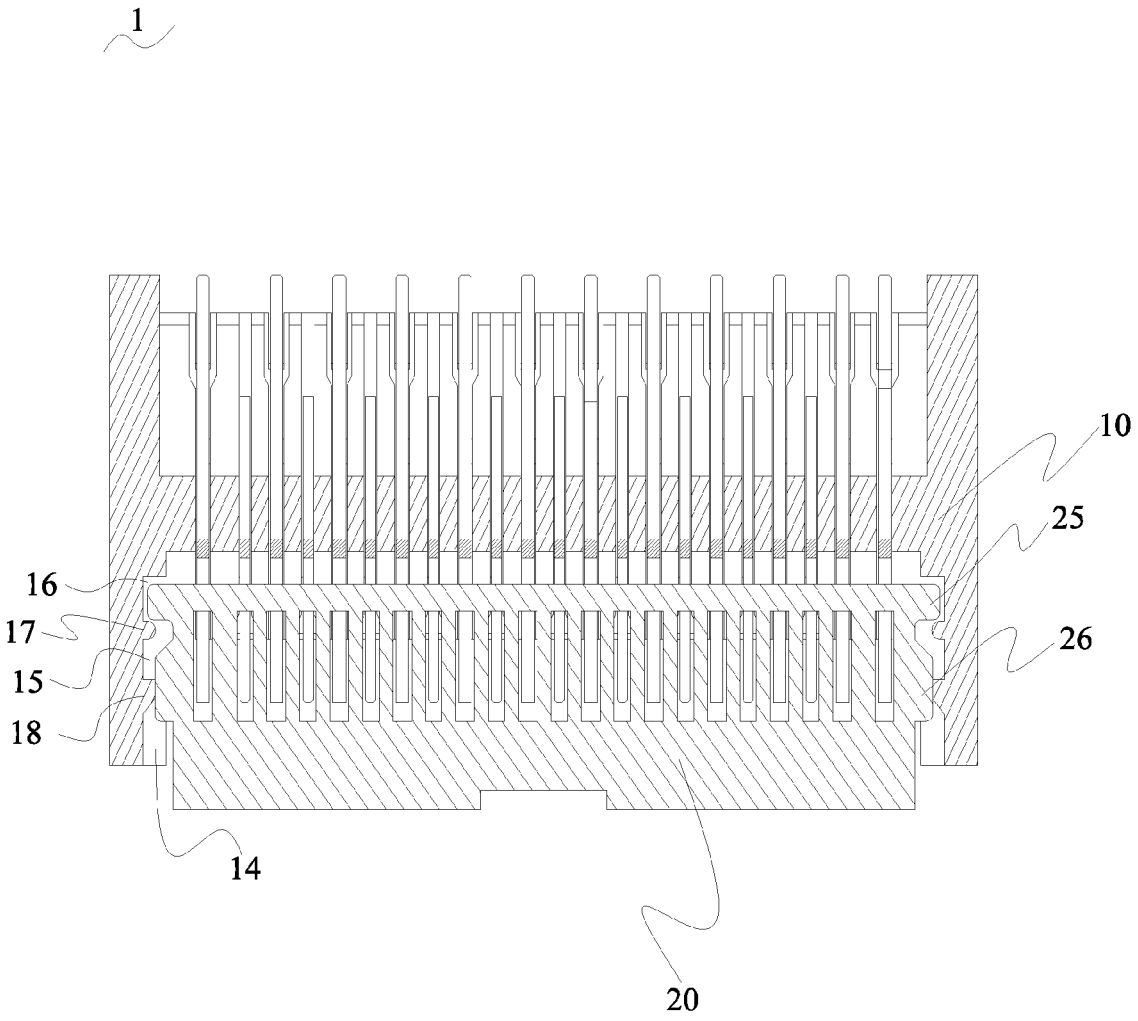
FIG. 9 is a cross-sectional view of the FPC connector of FIG. 1, wherein the actuator of the FPC connector is fully closed.

Referring to FIGS. 2-4, the insulating housing 10 is of rectangular shape and disposed levelly. A rear of the insulating housing 10 defines a rectangular mouth 11 opened freely. A bottom of a front wall of the mouth 11 extends rearward to form a tongue board 12 extending transversely. Each of two side walls 13 of the mouth 11 defines a guiding channel 14 at a rear thereof extending longitudinally to penetrate through a rear surface of the insulating housing 10, a second locating trough 16 at a front thereof, and a first locating trough 15 located between the second locating trough 16 and the guiding channel 14. The guiding channel 14, the first and the second locating troughs 15, 16 are substantially aligned with one another along a longitudinal direction. A semi-columned projection 17 extending vertically is formed between the first locating trough 15 and the second locating trough 16, and a prop lump 18 is formed between the first locating trough 15 and the guiding channel 14. The insulating housing 10 further defines a rectangular receiving recess 101 extending transversely and passing through a front surface 19 thereof to receive an FPC board 5 therein shown in FIGS. 7-8. A bottom surface of the receiving recess 101 defines a plurality of first passageways 102 and a plurality of second passageways 103 alternately arranged at regular intervals along a transverse direction thereof. A top surface of the receiving recess 101 defines a plurality of first receiving grooves 104 and a plurality of second receiving grooves 105 alternately arranged at regular intervals along a transverse direction thereof to respectively correspond to the second passageways 103 and the first passageways 102. A plurality of connecting slots 106 are formed in the front wall of the mouth 11 to further communicate with the receiving recess 101, and each extend vertically to connect the first/second passageway 102/103 and the corresponding second/first receiving groove 105/104.

Referring to FIG. 2 again, the actuator 20 has a substantially rectangular base body 21 disposed levelly. A front of the base body 21 defines a plurality of holding slots 22 penetrating from top to bottom and arranged at regular intervals along a transverse direction thereof. Accordingly, a plurality of prop beams 23 are formed in front of the respective holding slots 22. Each of the prop beams 23 has a substantially oval radial-section of which the major axis extends vertically to be perpendicular to the base body 21 and the minor axis extends longitudinally. The prop beams 23 are connected with one another to form a pressing bar 24 extending transversely. A pair of columned piloting portions 25 is formed by two opposite ends of the pressing bar 24 oppositely protruding. Two opposite sides of the actuator 20 oppositely protrude outward to form a pair of locking blocks 26 located behind and spaced from the corresponding piloting portions 25.

Figure 5:
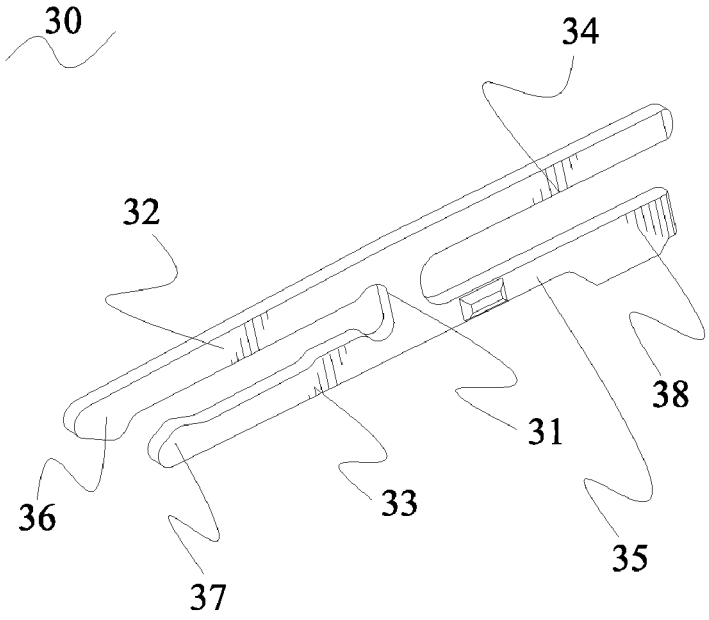
FIG. 5 is a perspective view of a first electric terminal of the FPC connector of FIG. 1.

Referring to FIG. 2 and FIG. 5, each of the first electric terminals 30 is a lying-H shaped base frame and has a first base portion 31 extending vertically. A front edge of the first base portion 31 extends forward to form a first contacting arm 32 at a top thereof and a first connecting arm 33 shorter than the first contacting arm 32 at a bottom thereof. A rear edge of the first base portion 31 extends rearward to form a first bearing arm 34 at a top thereof and a first holding arm 35 at a bottom thereof. A free end of the first contacting arm 32 protrudes downward to form a first contacting portion 36 and a free end of the first connecting arm 33 protrudes upward to form a holding lump 37. A free end of the first holding arm 35 protrudes downward to form a first soldering portion 38.

Figure 6:
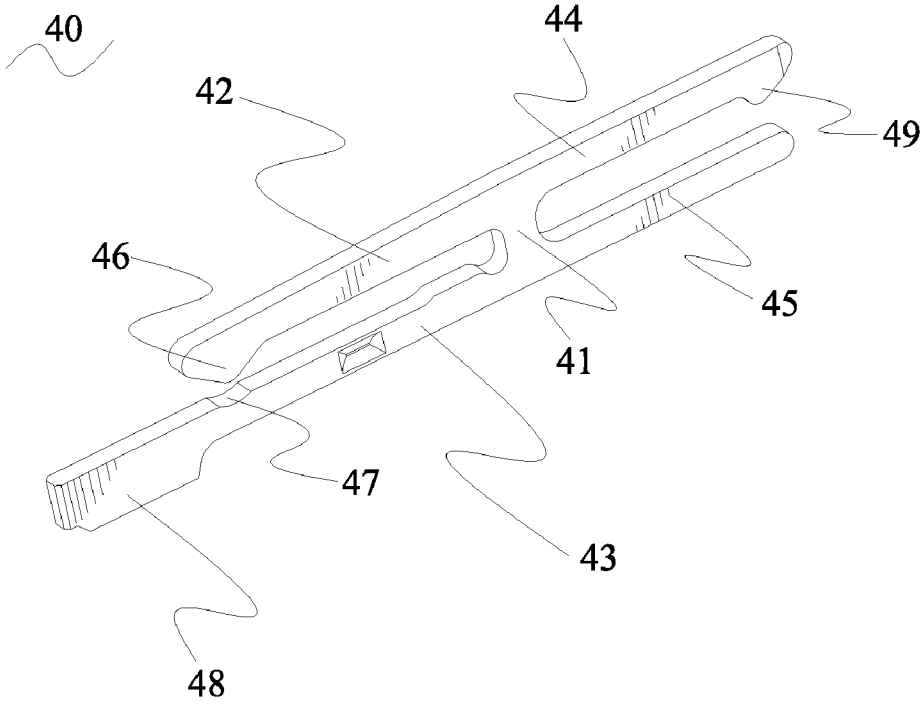
FIG. 6 is a perspective view of a second electric terminal of the FPC connector of FIG. 1.

Referring to FIG. 2 and FIG. 6, each of the second electric terminals 40 is a lying-H shaped base frame and has a second base portion 41 extending vertically. A front edge of the second base portion 41 extends forward to form a second contacting arm 42 at a top thereof and a second connecting arm 43 longer than the second contacting arm 42 at a bottom thereof. A rear edge of the second base portion 41 extends rearward to form a second bearing arm 44 at a top thereof and a second holding arm 45 at a bottom thereof. A free end of the second contacting arm 42 protrudes downward to form a second contacting portion 46. A portion of the second connecting arm 43 defines a notch 47 facing the second contacting portion 46 and a free end of the second connecting arm 43 protrudes downward to form a second soldering portion 48. A free end of the second bearing arm 44 protrudes downward to form an interference portion 49.

Referring to FIGS. 2-9, in assembly, the first electric terminals 30 are inserted forward with the first base portions 31 inserted in the corresponding connecting slots 106 of the insulating housing 10, the first contacting arms 32 received in the corresponding second receiving grooves 105, the first connecting arms 33 and the first holding arms 35 fastened in the corresponding first passageways 102, and the first bearing arms 34 stretching into the mouth 11. The first soldering portion 38 is exposed out of a rear edge of the tongue board 12 for being soldered with a printed circuit board (not shown). The second electric terminals 40 are inserted rearward with the second base portions 41 inserted in the corresponding connecting slots 106 of the insulating housing 10, the second contacting arms 42 received in the corresponding first receiving grooves 104, the second connecting arms 43 and the second holding arms 45 fastened in the corresponding second passageways 103, and the second bearing arms 44 stretching into the mouth 11. The second soldering portion 48 is exposed out of a front of the corresponding second passageway 103 for being soldered with the printed circuit board. The first soldering portion 38 and the second soldering portion 48 are set at two opposite sides of the insulating housing 10 and alternately arranged so as to strengthen the soldering between the FPC connector 1 and the printed circuit board. The actuator 20 is rotatablely mounted in the mouth 11 of the insulating housing 10 above the tongue board 12 with the piloting portions 25 pivoted in the corresponding first locating troughs 15. The bearing arms 34, 44 pass through the corresponding holding slots 22 to make the prop beams 23 locate under the corresponding bearing arms 34, 44 in front of the corresponding interference portions 49, so the actuator 20 can be prevented from falling off the insulating housing 10 while opened and closed.

When the FPC connector 1 is in use, the FPC board 5 is inserted rearward into the receiving recess 101 of the insulating housing 10 and located between the contacting arms 32, 42 and the connecting arms 33, 43 of the electric terminals 30, 40 so as to electrically contact the contacting portions 36, 46. Then the actuator 20 is closed rearward in the mouth 11 on the tongue board 12 to make the prop beams 23 push the corresponding bearing arms 34, 44 upward that drives the corresponding contacting arms 32, 42 to incline downward and further drives the contacting portions 36, 46 to move downward to electrically contact the FPC board 5 due to a fulcrum function of the corresponding base portions 31, 41. Then the actuator 20 is further pushed forward to make the piloting portions 25 slide into the corresponding second locating troughs 16 by way of the projections 17, and the locking blocks 26 slid onto and abutted against the corresponding prop lumps 18 along the corresponding guiding channels 14 so that the actuator 20 is firmly clipped between the two prop lumps 18. At this moment, the prop beams 23 are nearer to the base portions 31, 41 so that further pushes the corresponding bearing arms 34, 44 upward to further drive the corresponding contacting arms 32, 42 to incline downward so as to further firmly clip the FPC board 5 by means of the contacting portions 36, 46, the holding lumps 37 and the notches 47 and further ensure a steady electrical connection between the FPC board 5 and the electric terminals 30, 40.

When the FPC board 5 is to be withdrawn from the FPC connector 1, the actuator 20 is pulled rearward to make the piloting portions 25 slide into the corresponding first locating troughs 15 and the locking blocks 26 move off the corresponding prop lumps 18, and then the actuator 20 is opened forward to drive the prop beams 23 rotate to make the bearing arms 34, 44 move downward due to self-elasticity that further drives the contacting arms 32, 42 and the contacting portions 36, 46 to move upward due to the fulcrum function of the corresponding base portions 31, 41. When the actuator 20 is fully opened, the FPC board 5 can be easily withdrawn from the receiving recess 101 of the insulating housing 10.

As described above, the prop beams 23 of the actuator 20 are located between the bearing arms 34, 44 and the holding arms 35, 45 to make the FPC board 5 be tightly clipped between the contacting arms 32, 42 and the connecting arms 33, 43 by means of the fulcrum function of the corresponding base portions 31, 41 so as to ensure a more steady electrical connection between the electric terminals 30, 40 and the FPC board 5.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims, for example, the contacting portions for electrically an FPC board may be also disposed at the connecting arms of the electric terminals, correspondingly, the holding lumps and the notches may be disposed at the contacting arms of the electric terminals.

What is claimed is:

1. A connector adapted for receiving a longitudinally inserted flexible printed circuit board therein, comprising:

an insulating housing defining a mouth at a rear thereof and a receiving recess at a front thereof for receiving the flexible printed circuit board therein, a front wall of the mouth protruding rearward to form a tongue board, each side wall of the mouth defining a first locating trough and a second locating trough in front of the first locating trough, a projection being formed between the first locating trough and the second locating trough;

a plurality of electric terminals disposed in the insulating housing in a transverse row, each of the electric terminals having a lying-H shaped base frame which has a base portion, a contacting arm and a connecting arm extended frontward from the base portion and spaced from each other, and both a bearing arm and a holding arm extended rearward from an upper portion and a lower portion of the base portion respectively and spaced from each other, the contacting arm and the connecting arm being disposed in the inner surfaces of the receiving recess, the holding arm being disposed in the tongue board and the bearing arm stretching into the mouth, the flexible printed circuit board being inserted between the contacting arms and the connecting arms for electrically connecting the electric terminals; and an actuator pivoted in the mouth of the insulating housing above the tongue board, the actuator having a pressing bar transversely formed at an edge thereof and two piloting portions protruded oppositely from two opposite ends of the pressing bar, the pressing bar being located between the bearing arms and the holding arms, the piloting portions being slid into the corresponding second locating troughs from the first locating troughs pivoted with the piloting portions by way of the projections to act on the bearing arms by the pressing bar so as to make the contacting arms incline toward the corresponding connecting arms for further clipping the flexible printed circuit board therebetween after the actuator is closed.

2. The connector as claimed in claim 1, wherein the pressing bar has a substantially oval radial-section of which the major axis is perpendicular to the actuator.

3. The connector as claimed in claim 1, wherein the piloting portion is of columned shape and the shape of the projection is semi-columned to smoothly connect the first locating trough and the second locating trough.

4. The connector as claimed in claim 1, wherein the side wall of the mouth further defines a guiding channel behind the first locating trough, a prop lump is formed between the guiding channel and the first locating trough, two opposite sides of the actuator oppositely protrude outward to form a pair of locking blocks slid onto and abutted against the corresponding prop lumps from the respective guiding channels when the piloting portion is slid into the second locating trough from the first locating trough.

5. The connector as claimed in claim 4, wherein the actuator defines a plurality of holding slots located behind and arranged along the pressing bar, the bearing arms of the electric terminals overstride the pressing bar to be received in the corresponding holding slots when the actuator is closed.

6. The connector as claimed in claim 1, wherein a free end of the contacting arm protrudes downward to form a contacting portion electrically contacting the flexible printed circuit board, a plurality of holding lumps and notches are alternately formed on the corresponding connecting arms against the flexible printed circuit board.

7. The connector as claimed in claim 6, wherein the electric terminals disposed in the insulating housing in the transverse row have respective soldering portions alternately formed at front ends of the connecting arms and at rear ends of the holding arms for respectively being exposed from a front and a rear of the insulating housing to ensure a stable soldering.

* * * * *